US009427953B2

(12) United States Patent
Shibata et al.

(10) Patent No.: US 9,427,953 B2
(45) Date of Patent: Aug. 30, 2016

(54) METHOD OF MANUFACTURING LIQUID EJECTION HEAD

(71) Applicant: CANON KABUSHIKI KAISHA, Tokyo (JP)

(72) Inventors: Kazuaki Shibata, Oita (JP); Makoto Sakurai, Kawasaki (JP); Yuzuru Ishida, Yokohama (JP); Sadayoshi Sakuma, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 133 days.

(21) Appl. No.: 13/945,283

(22) Filed: Jul. 18, 2013

(65) Prior Publication Data

US 2014/0030427 A1 Jan. 30, 2014

(30) Foreign Application Priority Data

Jul. 25, 2012 (JP) ..... 2012-164687

(51) Int. Cl.
*B41J 2/01* (2006.01)
*B41J 2/16* (2006.01)

(52) U.S. Cl.
CPC ..... *B41J 2/01* (2013.01); *B41J 2/1603* (2013.01); *B41J 2/1628* (2013.01); *B41J 2/1629* (2013.01); *B41J 2/1642* (2013.01); *B41J 2/1646* (2013.01)

(58) Field of Classification Search
CPC .... B41J 2/1621; B41J 2/1626; B41J 2/1648; B41J 2/1628; B41J 2/1629
USPC ..... 360/134, 128, 130.21; 29/25.35, 890.1, 29/890.142; 216/27; 347/54, 47, 56, 29, 347/48; 427/123, 125, 307; 438/745, 768, 438/700
See application file for complete search history.

(56) References Cited

U.S. PATENT DOCUMENTS 6,331,259 B1 12/2001 Ozaki et al.
6,472,125 B1 10/2002 Koide et al.
(Continued)

FOREIGN PATENT DOCUMENTS

JP 5-293971 A 11/1993
JP 2000-225708 A 8/2000
(Continued)

OTHER PUBLICATIONS

Pt . V Since this application is stored in the U.S. Patent and Trademark Office's Ifw system, copy thereof is not submitted due to a sua sponte waiver of 37 C.F.R. § 1.98(a)(2)(iii).
(Continued)

*Primary Examiner* — Michael Cleveland
*Assistant Examiner* — Tabassom Tadayyon Eslami
(74) *Attorney, Agent, or Firm* — Fitzpatrick, Cella, Harper & Scinto

(57) ABSTRACT

A method of manufacturing a liquid ejection head includes forming, on the substrate, a metal layer formed of a first metal, forming a liquid flow path pattern formed of a second metal that is a metal of a different kind from that of the first metal and that is dissolvable in a solution that does not dissolve the first metal, the liquid flow path pattern being formed on at least a part of a surface of the metal layer, covering the metal layer and the pattern with an inorganic material layer to be formed as the nozzle layer, forming the ejection orifices in the inorganic material layer, and removing the pattern by the solution. A standard electrode potential E1 of the first metal and a standard electrode potential E2 of the second metal have a relationship of E1>E2.

14 Claims, 3 Drawing Sheets

(56) References Cited

U.S. PATENT DOCUMENTS

| | | | | |
|---|---|---|---|---|
| 7,634,855 | B2 | 12/2009 | Tokunaga | |
| 2006/0270238 | A1* | 11/2006 | Izumi et al. | 438/700 |
| 2007/0153062 | A1* | 7/2007 | Shie et al. | 347/56 |
| 2011/0003405 | A1* | 1/2011 | Yeh et al. | 438/21 |
| 2011/0123932 | A1* | 5/2011 | Guan et al. | 430/320 |
| 2012/0047737 | A1* | 3/2012 | Ishida et al. | 29/890.1 |
| 2013/0271938 | A1* | 10/2013 | Lindert et al. | 361/782 |

FOREIGN PATENT DOCUMENTS

| | | | |
|---|---|---|---|
| JP | 2001-287373 | A | 10/2001 |
| JP | 2005-97715 | A | 4/2005 |
| JP | 2006-69206 | A | 3/2006 |
| JP | 2006-510508 | A | 3/2006 |
| JP | 2006-248093 | A | 9/2006 |
| JP | 2011-102036 | A | 5/2011 |
| WO | 2004/056573 | A1 | 7/2004 |
| WO | 2004/056574 | A1 | 7/2004 |

OTHER PUBLICATIONS

Notification of Reason for Refusal in Japanese Application 2012-164687 (dispatched Apr. 26, 2016).

* cited by examiner

METHOD OF MANUFACTURING LIQUID EJECTION HEAD

BACKGROUND OF THE INVENTION

1. Field of the Invention

The present invention relates to a method of manufacturing a liquid ejection head such as an ink jet recording head that ejects ink for recording.

2. Description of the Related Art

A liquid ejection head applied to a liquid jet recording system (for example, an ink jet recording system) typically includes a nozzle layer having minute ejection orifices and a liquid flow path. Multiple liquid ejection energy generating portions are included in a part of the liquid flow path. A method of manufacturing a liquid ejection head has been proposed, in which, by forming the nozzle layer of an inorganic material, the ejection orifices and the liquid flow path can be formed with high dimensional accuracy, and further, the liquid ejection head does not swell under the influence of moisture in liquid such as ink ejected from the ejection orifices.

In Japanese Patent Application Laid-Open No. 2000-225708, an ink jet recording head is proposed, having a structure in which Al is used as a material for forming an ink flow path pattern and an inorganic material such as $SiO_2$ or SiN is used as a material for an orifice plate (nozzle layer) to form ink ejection orifices and an ink flow path. Further, in Japanese Patent Application Laid-Open No. 2000-225708, when an Al film that is the ink flow path pattern is removed, a method is used, in which etching is carried out using an etchant such as hydrochloric acid or phosphoric acid at room temperature.

SUMMARY OF THE INVENTION

According to an aspect of the present invention, there is provided a method of manufacturing a liquid ejection head, the liquid ejection head including:

a substrate having an ejection energy generating element for generating energy for ejecting liquid formed therein; and a nozzle layer having an ejection orifice and a liquid flow path formed therein, the ejection orifice being provided for ejecting the liquid, the liquid flow path communicating to the ejection orifice and being provided for placing the liquid above the ejection energy generating element, the method including: (1) forming a metal layer comprising a first metal on the substrate having the ejection energy generating element formed therein; (2) forming a liquid flow path pattern comprising a second metal that is dissolvable in a solution that does not dissolve the first metal, the liquid flow path pattern being formed on at least a part of a surface of the metal layer; (3) covering the metal layer and the liquid flow path pattern with an inorganic material to form an inorganic material layer to be formed as the nozzle layer; (4) forming the ejection orifice in the inorganic material layer; and (5) dissolving the liquid flow path pattern in the solution to remove the liquid flow path pattern, to thereby form the liquid flow path, in which the first metal and the second metal are metals of different kinds, and a standard electrode potential E1 of the first metal and a standard electrode potential E2 of the second metal have a relationship of "E1>E2".

Further features of the present invention will become apparent from the following description of exemplary embodiments with reference to the attached drawings.

DESCRIPTION OF THE EMBODIMENTS

Figure 1A:
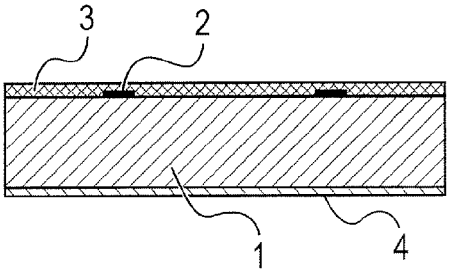
FIGS. 1A, 1E, 1C, 1D, 1E, 1F, 1G and 1H illustrate an exemplary method of manufacturing a liquid ejection head according to the present invention.

The ink jet recording head disclosed in Japanese Patent Application Laid-Open No. 2000-225708 uses a substrate having energy generating elements formed therein, and, ordinarily, unevenness due to the energy generating elements is generated on a surface of the substrate. Therefore, when the ink flow path pattern (Al film) is removed and the ink flow path is formed, the ink flow path pattern (Al film) to be removed by the etching may remain in the uneven portion. In particular, when the ink flow path to be formed is low in height, the etchant tends to be insufficiently replaced in the ink flow path, which further makes it difficult to remove the ink flow path pattern (Al film).

Note that, in the process of forming the energy generating elements in the substrate, a planarization technology such as chemical mechanical polishing (CMP) can be used to eliminate the unevenness on the surface of the substrate, but this may greatly increase the cost. Further, for example, it is also possible to strictly define the etching conditions such as an extended etching time period of the ink flow path pattern, but this not only may reduce the productivity but also, depending on the kind of the etchant, may damage a protective layer for protecting the energy generating elements, and thus, is not preferred also from the viewpoint of the reliability of the recording head.

An object of the present invention is to provide a method of manufacturing a liquid ejection head which can form a liquid flow path with high accuracy, which can stabilize the volume of a liquid droplet ejected from election orifices, and which can achieve high quality recording by removing with ease and with reliability an inorganic material (second metal) that forms a liquid flow path pattern.

(Liquid Ejection Head)

A liquid ejection head obtained by the method according to the present invention may be mounted on such apparatus as a printer, a copying machine, a facsimile having a communication system, and a word processor having a printer portion, and further, on a recording apparatus for industrial use which is combined with various kinds of processing apparatus. Specifically, the liquid ejection head can be used as an ink jet recording head that ejects ink onto a recording medium for recording, or a liquid ejection head for manufacturing a biochip or for printing an electronic circuit. By using this liquid ejection head as the ink jet recording head, recording may be performed on various kinds of recording media such as paper, thread, fabric, cloth, leather, metal, plastic, glass, lumber, and ceramic.

Note that, the term "recording" as used herein means not only applying an image having meaning such as text or graphics onto a recording medium but also applying an image having no meaning such as a pattern.

Further, the term "liquid" as used herein should be read broadly and denotes liquid that is applied onto a recording medium to form an image, a motif, a pattern, or the like or to process the recording medium, or for a treatment of an ink or the recording medium. The treatment of the ink or the recording medium means, for example, improvement of fixability by coagulation or insolubilization of a color material contained in the ink applied onto the recording medium, improvement of recording quality or a chromogenic property, improvement of image durability, and the like.

In the following, description is made focusing on an application for, among these liquid ejection heads, an ink jet recording head for ejecting ink as the liquid, but the present invention is not limited thereto.

Figure 2:
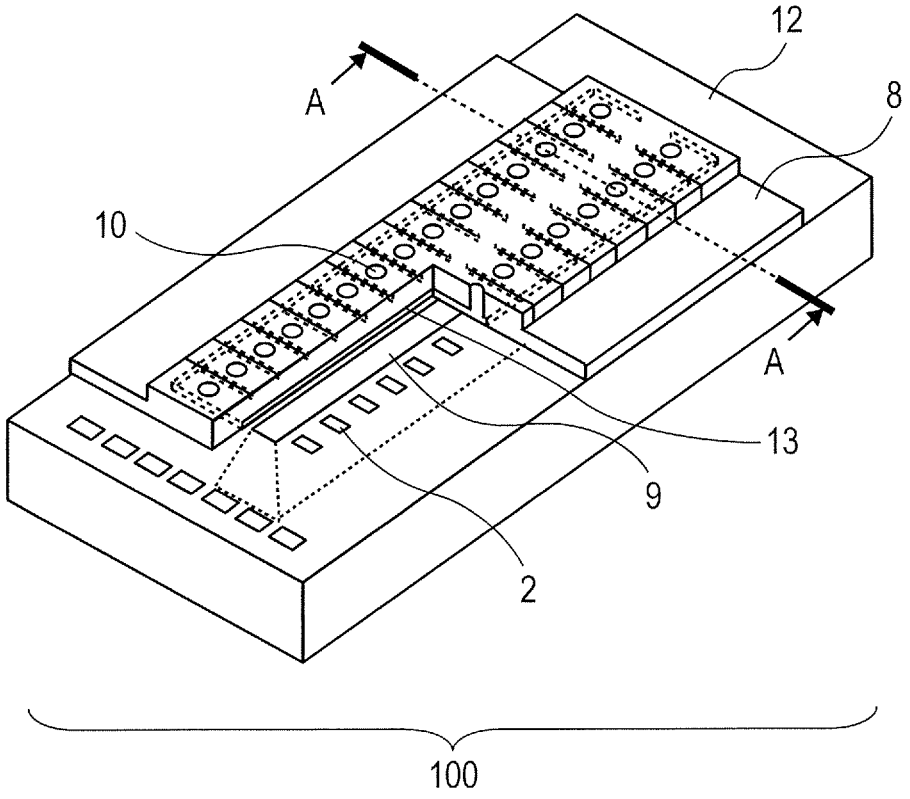
FIG. 2 is a perspective view illustrating an exemplary liquid ejection head obtained by the method according to the present invention.

First, FIG. 2 is a perspective view illustrating an exemplary liquid ejection head (ink jet recording head) obtained by the method according to the present invention.

An ink jet recording head 100 includes a substrate (election element substrate) 12 having ejection energy generating elements 2 formed therein, and a nozzle layer (orifice plate material) 8 having ink ejection orifices (ejection orifices) 10 and an ink flow path (liquid flow path) 13 formed therein. Further, the ink jet recording head 100 includes a metal layer (6 in FIGS. 1C to 1H) formed of a first metal described below between the nozzle layer 8 and the ejection element substrate 12 (except for an ink supply port portion). Specifically, the metal layer 6 is formed at least between an ink flow path 13 and the ejection element substrate 12 (except for the ink supply port portion). Further, the nozzle layer 6 may be formed of a single layer or may be formed of multiple layers.

The ejection energy generating elements 2 are elements for generating energy provided to eject ink (liquid), and, as the ejection energy generating elements 2, heat generating resistance elements for ejecting ink by generating heat or pressure generating elements for ejecting ink by generating pressure can be used.

Figure 1B:
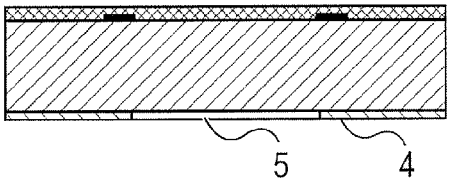
Figure 1C:
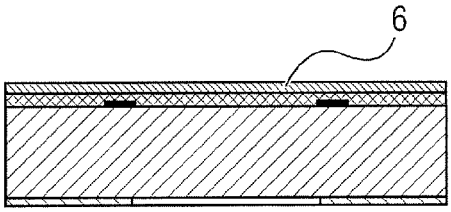
Figure 1D:
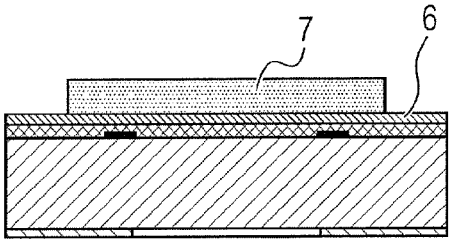
Figure 1E:
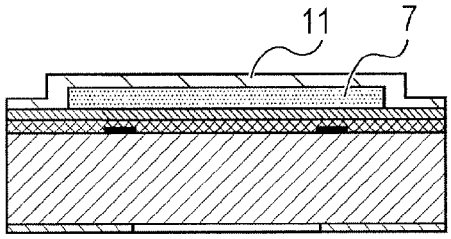
Figure 1F:
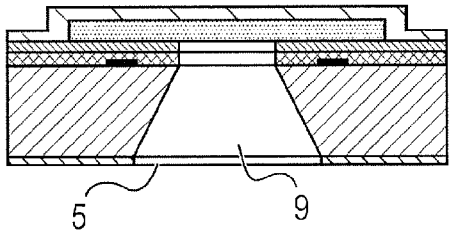
Figure 1G:
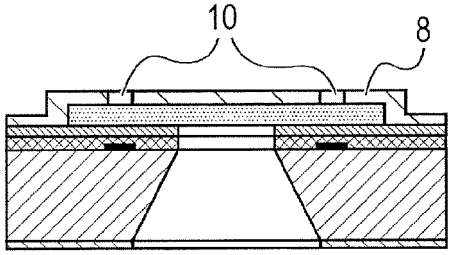
Figure 1H:
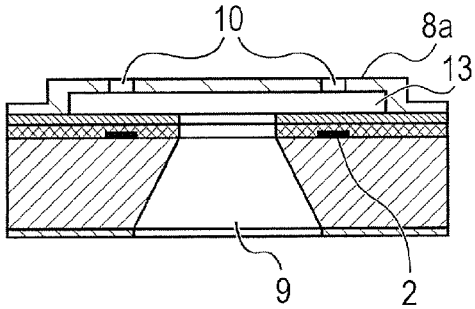

The ejection orifices 10 are for ejecting ink, and, for example, as illustrated in FIG. 1H, can be formed in portions of the nozzle layer 8 above the ejection energy generating elements 2 (upward in the plane of the drawings), respectively, and, ordinarily, multiple ejection orifices 10 are formed in one ink jet recording head. In the ink jet recording head 100 obtained by the method according to the present invention, the volume of an ink droplet to be ejected from the ink ejection orifices 10 may be uniform.

The ink flow path 13 communicates to the ejection orifices 10 and is provided for the purpose of placing ink above the ejection energy generating elements 2.

Note that, the ejection element substrate 12 can include an ink supply port (liquid supply port) 9 formed therein which communicates to the ink flow path 13 and is provided for the purpose of supplying ink thereto. In the ink jet recording head 100 illustrated in FIG. 2, two ejection orifice lines each formed by arranging the ejection orifices 10 at equal intervals in a longitudinal direction of the head 100 are arranged so as to be in parallel with each other, and the ink supply port 9 is provided between the two ejection orifice lines.

When the ink jet recording head 100 is used to perform recording onto a recording medium such as papery the ink jet recording head 100 is placed so that a surface thereof in which the ink ejection orifices 10 are formed (ejection orifice surface 8*a* illustrated in FIG. 1H) faces a recording surface of the recording medium. Energy generated by the ejection energy generating elements 2 is used for ink filled into the ink flow path 13 via the ink supply port 9 to eject ink droplets from the ink ejection orifices 10. By causing the ink droplets to adhere onto the recording medium, recording is performed.

(Method of Manufacturing Liquid Ejection Head)

A method of manufacturing a liquid ejection head according to the present invention includes the following steps:

(1) a step of forming a metal layer made of a first metal on the ejection element substrate;

(2) a step of forming a liquid flow path pattern made of a second metal that is dissolvable in a solution that does not dissolve the first metal, the liquid flew path pattern being formed on at least a part of a surface of the metal layer;

(3) a step of covering the metal layer and the liquid flow path pattern with an inorganic material to form an inorganic material layer to be formed as a nozzle layer;

(4) a step of forming the ejection orifices in the inorganic material layer; and (5) a step of dissolving the liquid flow path pattern in the solution (etchant) to remove the liquid flow path pattern, to thereby form the liquid flow path.

According to the present invention, the first metal and the second metal are metals of different kinds, and, a standard electrode potential E1 of the first metal and a standard electrode potential E2 of the second metal have a relationship of "E1>E2".

Note that, "the first metal and the second metal are metals of different kinds" means that a metal element that is a main component of the first metal and a metal element that is a main component of the second metal are different from each other. However, from the viewpoint of the galvanic corrosion between the first metal and the second metal, it is preferred that the structure of the main metal element of the first metal and the structure of the main metal element of the second metal be different from each other, and it is more preferred that the first metal and the second metal do not contain the same metal element. Note that, "a metal element that is a main component" means a metal element whose content is the highest among the components of the metal in mass %. Both of the first metal and the second metal may be pure metals each of which are formed of a single metal element, or may be alloys each of which are formed of multiple metal elements and nonmetal elements.

Further, the standard electrode potentials of the first metal and the second metal mean standard electrode potentials using a hydrogen electrode as the standard, and mean standard electromotive forces when a standard hydrogen electrode is used as a reference electrode to be the standard. Specifically, a standard electrode potential can be determined by measuring a potential difference in an oxidation-reduction reaction between an electrode formed of the metal to be measured and the reference electrode (standard hydrogen electrode). Note that, as the reference electrode, other electrodes such as a silver-silver chloride electrode may be used. When these other electrodes are used, the measured value (electrode potential) is used after being converted to a value with the hydrogen electrode as the standard.

Further, the manufacturing method may include a step of preparing the ejection element substrate before the step 1, and may include a step of forming, in the ejection element substrate and the metal layer, a liquid supply port that passes through the substrate and the metal layer between the step 3 and the step 4.

The respective steps in the manufacturing method according to the present invention are described in detail in the following by way of an example of an ink jet recording head with reference to the attached drawings.

Note that, FIGS. 1A to 1H and FIGS. 3A to 3E illustrate methods of manufacturing a liquid ejection head (for example, an ink jet recording head) according to the present invention, and illustrate the respective steps in sectional views corresponding to the sectional view taken along the line A-A of FIG. 2 illustrating the head.

(Step of Preparing Ejection Element Substrate)

First, a substrate (ejection element substrate) having the ejection energy generating elements 2 formed thereon is prepared. In the ejection element substrate illustrated in FIG. 1A, the ejection energy generating elements 2, a protective layer (protective film) 3 made of, for example, SiN or SiCN, for protecting the elements 2, and a circuit (not shown) for driving the elements 2 are formed on a silicon substrate 1 using a publicly known semiconductor technology. Further, a thermal oxide film 4 (for example, an $SiO_2$ film) formed in the process of forming the circuit for driving the ejection energy generating elements 2 covers a rear surface of the silicon substrate 1. Note that, as used herein, a front surface of the silicon substrate or the election element substrate means a surface thereof on a side on which the nozzle layer is provided, while the rear surface thereof means a surface thereof which is opposed to the front surface.

Next, as illustrated in FIG. 1B, after a resist (for example, a novolac-based resist) is applied onto the thermal oxide film 4 (specifically, onto the surface of the thermal oxide film) and exposure and development thereof are carried out, the thermal oxide film 4 is etched to form an opening 5. The thermal oxide film 4 can act as a mask when the ink supply port 9 is formed later, and the ink supply port 9 can be formed with reference to the opening 5.

Exemplary methods of etching the thermal oxide film 4 include dry etching and wet etching. The dry etching can be carried out using an etching gas such as $CF_4$, and the wet etching can be carried out using an etchant such as buffered hydrofluoric acid.

(Step 1)

Next, as illustrated in FIG. 1C, the metal layer 6 made of the first metal is formed on the obtained ejection element substrate. Specifically, the metal layer 6 can be formed by forming a film of the first metal on the ejection element substrate by, for example, sputtering or vapor deposition, and by shaping, as necessary, the metal film by, for example, the following method. As the method of shaping the metal film, for example, a method can be used, in which, after a resist is applied to the surface of the metal film and exposure and development thereof are carried out, the metal film is formed into a desired shape by, for example, etching. Note that, exemplary methods of the etching include dry etching and wet etching.

In this case, when, for example, a metal selected from the first group to be described later (consisting of Au, Pt, and Ir) is used as the first metal, the metal film can be etched by dry etching using an etching gas such as a gas mixture in which $Cl_2$, $BCl_3$, Ar, and the like are mixed.

The metal layer 6 may be directly formed on a surface (specifically, the front surface) of the ejection element substrate, or, still another layer (for example, an adhesive layer) may be formed between the metal layer 6 and the ejection element substrate.

Note that, the metal layer 6 may be formed on the entire front surface of the ejection element substrate, but is formed at least between a region in which an ink flow path pattern 7 is formed and the ejection element substrate.

In this case, the first metal is a metal that is not dissolved in a solution that, in the step 5, dissolves and removes the second metal forming the ink flow path pattern 7, and the first metal is of a different kind from that of the second metal. Further, the standard electrode potential E1 of the first metal and the standard electrode potential E2 of the second metal have the relationship of E1>E2. Any publicly known metals and alloys that satisfy these conditions can be used as the first metal and the second metal. When, in the step 5, the substrate in which the first metal and the second metal that satisfy these conditions are placed so as to be held in contact with each other is immersed in an etchant, the etching rate of the ink flow path pattern 7 formed of the second metal is improved due to the galvanic corrosion. Therefore, even if there is unevenness on the surface of the substrate obtained in the step 4 due to, for example, the ejection energy generating elements 2, compared with a conventional case, the ink flow path pattern 7 can be removed with more efficiency and with more reliability. Note that, the galvanic corrosion is a phenomenon that, when two materials (for example, the first metal and the second metal) are held in contact with each other and, under this state, are immersed in an electrolyte solution such as an etchant, due to the difference in ionization tendency between the two materials, that is, the difference in standard electrode potential, the etching rate of one of the materials becomes higher.

According to the present invention, it is desired that a metal having a positive (+) the standard electrode potential be used as the first metal and a metal having a negative (−) standard electrode potential be used as the second metal. Further, according to the present invention, it is preferred to select the first metal and the second metal so that the potential difference between E1 and E2 is as large as possible. This enables removal of the ink flow path pattern 7 with further efficiency and with further reliability. Further, the metal layer 6 formed of the first metal can also act as a cavitation resistant film for protecting the ejection energy generating elements 2 and the like from being broken by cavitation when bubbles burst.

As described above, it is desired to use, as the first metal, a chemically stable metal that is resistant to cavitation and has a positive standard electrode potential. Exemplary such metals include gold (Au), platinum (Pt), iridium (Ir), alloys that contain Au as the main component, alloys that contain Pt as the main component, and alloys that contain Ir as the main component. Note that, a main component means a component whose content is the highest among the entire components in mass %. In an alloy that contains Au as the main component, the component whose content is the highest among the entire components in the alloy in mass % is Au. Note that, the compositions of the first metal and the second metal can be appropriately set insofar as the effects of the present invention can be obtained. However, as the first metal is closer to a pure metal, uniform galvanic corrosion with the second metal becomes easier to obtain, and thus, it is particularly preferred to use a pure metal such as Au, Pt, or Ir as the first metal.

(Step 2)

Next, as illustrated in FIG. 1D, the ink flow path pattern 7 formed of the second metal that is dissolvable in a solution that does not dissolve the first metal is formed on at least a part of a surface of the metal layer 6. Specifically, when, as illustrated in FIG. 1C, the metal layer 6 is formed also on a portion other than a portion between the region in which the ink flow path pattern 7 is formed and the ejection element substrate in the step 1, the ink flow path pattern 7 is formed on a part of the surface of the metal layer 6 that is formed on the ejection element substrate. When the metal layer 6 is formed only in the portion between the region in which the ink flow path pattern 7 is formed and the ejection element substrate in the step 1, the ink flow path pattern 7 is formed on the entire surface (front surface) of the metal layer 6 formed on the ejection element substrate.

In this case, the second metal can be any one of publicly known metals and alloys that satisfy the above-mentioned conditions with regard to the second metal, that is, a) being of a different kind from that of the first metal, b) satisfying E1>E2, and c) being dissolvable in a solution that does not dissolve the first metal. Exemplary metals used as the second metal include Ti, TiW, Al, and alloys that contain Al as the main component.

Specifically, when the first metal is a metal selected from the group (first group) consisting of Au, Pt, Ir, alloys that contain Au as the main component, alloys that contain Pt as the main component, and alloys that contain Ir as the main component, the second metal can be any one of the following metals. In this case, the second metal can be a metal selected from a group consisting of Ti, W, TiW, Al, and alloys that contain Al as the main component. Note that, the group consisting of Ti, W, and TiW is hereinafter referred to as a second group, and the group consisting of Al and alloys that contain Al as the main component is hereinafter referred to as a third group.

Note that, the content ratio of Al in the alloy containing Al as the main component, which is used as the second metal, can be appropriately set insofar as the effects of the present invention can be obtained. However, it is preferred that the second metal be a pure metal because of the easiness of obtaining uniform galvanic corrosion.

Note that, specifically, the ink flow path pattern 7 can be formed by, for example, the following method. The ink flow path pattern 7 having a desired shape can be formed by forming a film of the second metal on the surface of the metal layer 6 by, for example, sputtering or vapor deposition, applying a resist to the surface of the film formed of the second metal, carrying cue exposure and development, and then, carrying out etching. Exemplary methods of etching the film formed of the second metal include dry etching and wet etching.

When, for example, a metal selected from the first group is used as the first metal and a metal selected from the group consisting of Ti, W, and TiW (metal selected from the second group) is used as the second metal, the dry etching can be carried out using, for example, an etching gas such as $CF_4$, $SF_6$, or $CCl_4$. Further, the wet etching can be carried out using, for example, hydrogen peroxide water or a solution whose main component is hydrogen peroxide water, in other words, a solution containing hydrogen peroxide ($H_2O_2$). The solution whose main component is hydrogen peroxide water is a solution in which the component whose content is the highest among the entire components in the solution is hydrogen peroxide water. The content ratio of hydrogen peroxide water in the solution can be, for example, 30 mass % or more and 35 mass % or less. Further, other than hydrogen peroxide water, ammonia water and the like can be contained in the solution. Note that, the concentrations of hydrogen peroxide and ammonia in the hydrogen peroxide water and the ammonia water, respectively, can be appropriately set in accordance with the first metal and the second metal which are used. For example, the concentration of hydrogen peroxide in the hydrogen peroxide water can be 10 mass % or more and 30 mass % or less.

Further, when, for example, a metal selected from the first group is used as the first metal and a metal selected from the group consisting of Al and alloys that contain Al as the main component (metal selected from the third group) is used as the second metal, the dry etching can be carried out using, for example, a gas mixture of Ar and $Cl_2$, or a gas mixture of $BCl_3$, $Cl_2$, and Ar. Further, the wet etching can be carried out using, for example, a solution such as a liquid mixture of hydrochloric acid and phosphoric acid and a liquid mixture of acetic acid, phosphoric acid, and nitric acid.

(Step 3)

Next, as illustrated in FIG. 1E, the metal layer 6 and the ink flow path pattern 7 are covered with an inorganic material to form an inorganic material layer 11 to be formed as the nozzle layer 8. Note that, the inorganic material layer 11 can be formed of a single layer as illustrated in FIG. 1E, or can be formed of multiple layers (for example, a first inorganic material layer 11*a* and a second inorganic material layer 11*b*) as illustrated in FIG. 3B. Further, one of the multiple layers can cover the ink flow path pattern 7. In FIGS. 3A to 3E, the first inorganic material layer 11*a* covers the ink flow path pattern 7. Further, in FIGS. 3B to 3E, the second inorganic material layer 11*b* covers the first inorganic material layer 11*a*.

Both of the inorganic material layer 11 formed of a single layer as illustrated in FIGS. 1A to 1H and the second inorganic material layer 11*b* can be formed of an inorganic material selected from the group consisting of, for example, SiN, SiO, and SiCN, and, for example, can be formed by chemical vapor deposition (CVD). Further, the first inorganic material layer 11*a* can be formed of a third metal that is not dissolved in the etchant that dissolves and removes the second metal in the step 5. The first inorganic material layer 11*a* formed of the third metal can be formed by, for example, the following method. First, a film formed of the third metal (first inorganic material layer 11*a*) is formed on the metal layer 6 and the ink flow path pattern 7 by sputtering or vapor deposition. Note that, when the film is patterned in a desired shape, by carrying out, after a resist is applied to the surface of the film and exposure and development thereof are carried out, dry etching using an etching gas such as $CF_4$, $SF_6$, or $CCl_4$, the first inorganic material layer 11*a* having a desired shape can be formed.

Note that, the third metal can be of a different kind from that of the second metal, and a standard electrode potential E3 of the third metal can have a relationship of E3>E2 with the standard electrode potential E2 of the second metal.

Specifically, when, for example, the first metal is a metal selected from the above-mentioned first group, the third metal can be, similarly, a metal selected from the first group. In this case, the second metal can be a metal selected from the above-mentioned second group and third group. Note that, the first metal and the third metal may be the same metal, or may be metals which are different from each other. Further, it is desired that, similarly to the first metal, the third metal be a metal having a positive (+) standard electrode potential. Further, from the viewpoint of removing the ink flow path pattern 7 with efficiency and with reliability, it is preferred to use a third metal with which the potential difference between E3 and E2 is as large as possible.

In this case, when the first inorganic material layer 11*a* formed of the third metal is used as the inorganic material layer which covers the ink flow path pattern 7, in the step 5, etching due to the galvanic corrosion progresses also from the first inorganic material layer 11*a* side. Therefore, compared with a case in which the first inorganic material layer 11*a* formed of the third metal is not used, the ink flow path pattern 7 formed of the second metal can be removed with more efficiency. Note that, when the first inorganic material layer 11*a* of the third metal is formed, the obtained ink jet recording head can be formed of wall surfaces of the ink flow path 13, the first metal, and the third metal.

(Step of Forming Ink Supply Port)

Next, as illustrated in FIG. 1F, the ink supply port 9 that passes through the ejection element substrate and the metal layer 6 is formed with the thermal oxide film 4 including the opening 5 illustrated in FIG. 1B being used as the mask.

Specifically, first, a region of the ejection element substrate, which is to be formed as the ink supply port 9, is wet etched and removed using an etchant such as tetramethylammonium hydroxide (TMAH) or potassium hydroxide (KOH) with the thermal oxide film 4 being used as the mask.

Next, when a metal selected from the first group is used as the first metal, a region of the metal layer 6, which is to be formed as the ink supply port 9, is etched by dry etching using an etching gas such as $BCl_3$ or $Cl_2$ to form the ink supply port 9 into a desired shape.

Note that, in this case, by, for example, dry etching using an etching gas such as a gas mixture of $Cl_2$, $BCl_3$, $CF_4$, and $SF_6$, the ejection element substrate and the metal layer 6 can be etched at the same time to form the ink supply port 9 which passes therethrough into a desired shape.

(Step 4)

Next, as illustrated in FIG. 1G, the ink ejection orifices 10 that pass through the inorganic material layer 11 are formed therein. Specifically, after a resist is applied to the surface of the inorganic material layer 11 and exposure and development thereof are carried out, the inorganic material layer 11 is etched by, for example, dry etching to form the ink ejection orifices 10. In this case, as the etching gas in the dry etching, for example, $CF_4$ can be used. Note that, when the inorganic material layer 11 is formed of multiple layers as illustrated in FIGS. 3A to 3E, the ink ejection orifices 10 that pass through these multiple layers are formed.

(Step 5)

Next, as illustrated in FIG. 1H, by dissolving the ink flow path pattern 7 in a solution (etchant) to remove the second metal through, for example, the ink supply port 9 and the ink ejection orifices 10, the ink flow path 13 is formed. The etchant can be appropriately selected in accordance with the first metal and the second metal hand the third metal when the third metal is used) which are used, and a solution which dissolves and removes only the second metal forming the ink flow path pattern 7 is used.

For example, when a metal in the first group is used as the first metal and a metal selected from the group consisting of Ti, W, and TiW (a metal in the second group) is used as the second metal, a solution selected from the group consisting of, for example, hydrogen peroxide water and a solution whose main component is hydrogen peroxide water can be used as the etchant. These etchants can be used after being heated to, for example, about 40° C. Note that, a preferred content ratio of hydrogen peroxide water in the solution whose main component is hydrogen peroxide water and other components which can be contained in the solution are similar to those described in the description with regard to the step 2.

Further, for example, when a metal in the first group is used as the first metal and a metal selected from the group consisting of Al and alloys that contain Al as the main component (a metal in the third group) is used as the second metal, a solution selected from the group consisting of, for example, a liquid mixture of hydrochloric acid and phosphoric acid and a liquid mixture of acetic acid, phosphoric acid, and nitric acid can be used as the etchant. These etchants can be used at, for example, room temperature (25° C.). Further, the composition ratios in these liquid mixtures can be appropriately set insofar as the effects of the present invention can be obtained.

Next, as necessary, a water-repellent film (not shown) containing Si is formed on the ink ejection orifice surface 8*a* by plasma polymerization. Then, an ink supply member (not shown) for supplying ink to the ink supply port 9 is bonded to the rear surface side of the ejection element substrate. In this way, the ink jet recording head can be completed. Note that, exemplary water-repellent films containing Si include an Si—F compound and a CSiF compound.

EXAMPLES

The present invention is further described in the following using examples, but the present invention is not limited thereto.

Example 1

First, as illustrated in FIG. 1B, after a resist was applied to the surface of the thermal oxide film 4 of the ejection element substrate illustrated in FIG. 1A and exposure and development thereof were carried out, the opening 5 was formed by wet etching using buffered hydrofluoric acid (BHF). In the ejection element substrate, neat generating resistance elements formed as the ejection energy generating elements 2, the protective layer 3 of SiN and SiCN for protecting the elements, and a circuit (not shown) for driving the elements were formed on the front surface of the silicon substrate 1 using a semiconductor technology. Further, the thermal oxide film 4 formed in the process of forming the circuit for driving the heat generating resistance elements 2 covered the rear surface of the silicon substrate 1.

Next, as illustrated in FIG. 1C, a metal film formed of Ir used as the first metal was formed by sputtering on the front surface of the ejection element substrate. Then, after a resist was applied onto the metal film and exposure and development thereof were carried out, the metal layer 6 formed of the first metal was formed in a portion to be provided between the nozzle layer 8 and the ejection element substrate by dry etching using $Cl_2$ and Ar (in the step 1). Specifically, the metal layer 6 was formed at least between the region to be formed as the ink flow path pattern 7 and the ejection element substrate.

Next, as illustrated in FIG. 1D, a metal film formed of Al used as the second metal was formed on the metal layer 6 by sputtering. Then, after a resist was applied onto the metal film and exposure and development thereof were carried out, the ink flow path pattern 7 formed of the second metal was formed on a part of the surface of the metal layer 6 by wet etching using a liquid mixture of acetic acid, nitric acid, and phosphoric acid (in the step 2).

Next, as illustrated in FIG. 1E, the metal layer 6 and the ink flow path pattern 7 were covered with SiCN by CVD to form the inorganic material layer 11 to be formed as the nozzle layer 8 (in the step 3).

Next, as illustrated in FIG. 1F, the ink supply port 9 passing through the ejection element substrate and the metal layer 6 was formed with the thermal oxide film 4 having the opening 5 formed therein being used as the mask. Specifically, a region of the ejection element substrate to be formed as the ink supply port 9 was etched by wet etching using TMAH, and a region of the metal layer 6 to be formed as the ink supply port 9 was etched by dry etching using $Cl_2$ and Ar. Thus, the ink supply port 9 was formed.

Next, as illustrated in FIG. 1G, after a resist was applied onto the inorganic material layer 11 and exposure and development thereof were carried out, the inorganic material layer 11 was etched by dry etching using $CF_4$ as the etching gas to form the ink ejection orifices 10 (in the step 4).

Next, as illustrated in FIG. 1H, the ink flow path pattern 7 formed of the second metal was removed through the ink supply port 9 and the ink ejection orifices 10 using a liquid mixture of hydrochloric acid and phosphoric acid as the etchant to form the ink flow path 13 (in the step 5).

Next, a water-repellent film (not shown) containing Si was formed on the ink ejection orifice surface 8*a* by plasma polymerization, and an ink supply member (not shown) was bonded to the rear surface side of the ejection element substrate to complete the ink jet recording head.

Note that, Ir used as the first metal and Al used as the second metal in Example 1 are metals of different kinds. Further, the standard electrode potential E1 of this first metal is 1.156 V and the standard electrode potential E2 of this second metal is −1.676 V, and thus, these metals satisfy the relationship of E1>E2. Therefore, due to the galvanic corrosion, the etching rate of the ink flow path pattern 7 formed of the second metal in the step 5 was improved, and, irrespective of the unevenness on the surface of the ejection element substrate, the ink flow path pattern 7 was able to be removed with efficiency and with reliability.

Example 2

Similarly to the case of Example 1, the ejection element substrate illustrated in FIG. 1B was obtained.

Next, as illustrated in FIG. 1C, a metal film formed of Pt used as the first metal was formed by sputtering on the front surface of the ejection element substrate. Then, after a resist was applied onto the metal film and exposure and development thereof were carried out, the metal layer 6 formed of the first metal was formed in a portion to be provided between the nozzle layer 8 and the ejection element substrate by dry etching using $Cl_2$ and Ar (in the step 1). Specifically, the metal layer 6 was formed at least between the region to be formed as the ink flow path pattern 7 and the ejection element substrate.

Next, as illustrated in FIG. 1D, a metal film formed of Al used as the second metal was formed on the metal layer 6 by sputtering. Then, after a resist was applied onto the metal film and exposure and development thereof were carried out, the ink flow path pattern 7 formed of the second metal was formed on a part of the surface of the metal layer 6 by dry etching using $Cl_2$ and Ar (in the step 2).

Next, as illustrated in FIG. 1E, the metal layer 6 and the ink flow path pattern 7 were covered with SiCN by CVD to form the inorganic material layer 11 to be formed as the nozzle layer 8 (in the step 3).

Next, as illustrated in FIG. 1F, the ink supply port 9 passing through the ejection element substrate and the metal layer 6 was formed with the thermal oxide film 4 having the opening 5 formed therein being used as the mask. Specifically, a region of the ejection element substrate to be formed as the ink supply port 9 was etched by wet etching using TMAH, and a region of the metal layer 6 to be formed as the ink supply port 9 was etched by dry etching using $Cl_2$ and Ar. Thus, the ink supply port 9 was formed.

Next, as illustrated in FIG. 1G, after a resist was applied onto the inorganic material layer 11 and exposure and development thereof were carried out, the inorganic material layer 11 was etched by dry etching using $CF_4$ as the etching gas to form the ink ejection orifices 10 (in the step 4).

Next, as illustrated in FIG. 1H, the ink flow path pattern 7 formed of the second metal was removed through the ink supply port 9 and the ink ejection orifices 10 using a liquid mixture of acetic acid, nitric acid, and phosphoric acid at room temperature (25° C.) as the etchant to form the ink flow path 13 (in the step 5).

Next, a water-repellent film (not shown) containing Si was formed on the ink ejection orifice surface 8*a* by plasma polymerization, and an ink supply member (not shown) was bonded to the rear surface side of the ejection element substrate to complete the ink jet recording head.

Note that, Pt used as the first metal and Al used as the second metal in Example 2 are metals of different kinds. Further, the standard electrode potential E1 of this first metal is 1.188 V and the standard electrode potential E2 of this second metal is −1.676 V, and thus, these metals satisfy the relationship of E1>E2. Therefore, due to the galvanic corrosion, the etching rate of the ink flow path pattern 7 formed of the second metal in the step 5 was improved, and, irrespective of the unevenness on the surface of the ejection element substrate, the ink flow path pattern 7 was able to be removed with efficiency and with reliability.

Example 3

First, similarly to the case of Example 2, the ejection element substrate having the metal layer 6 and the ink flow path pattern 7 formed thereon illustrated in FIG. 1D was obtained. Note that, in Example 3, Ir was used as the first metal which formed the metal layer 6 and Al was used as the second metal.

Figure 3A:
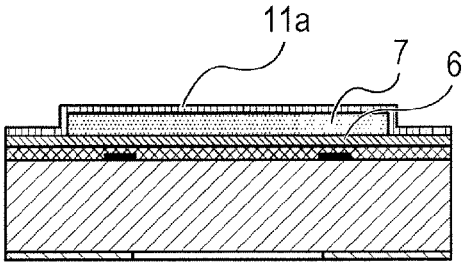
FIGS. 3A, 3B, 3C, 3D and 3E illustrate another exemplary method of manufacturing a liquid ejection head according to the present invention.

Next, as illustrated in FIG. 3A, the metal layer 6 and the ink flow path pattern 7 were covered by sputtering with the first inorganic material layer 11*a* formed of Ir which was used as the third metal.

Next, as illustrated in FIG. 3B, the first inorganic material layer 11*a* was covered with SiCN by CVD to form the second inorganic material layer 11*b*. In this way, the inorganic material layer which covered the metal layer 6 and the ink flow path pattern 7, which was formed of the first inorganic material layer 11*a* and the second inorganic material layer 11*b*, and which was to be formed as the nozzle layer 8 was formed (in the step 3).

Figure 3D:
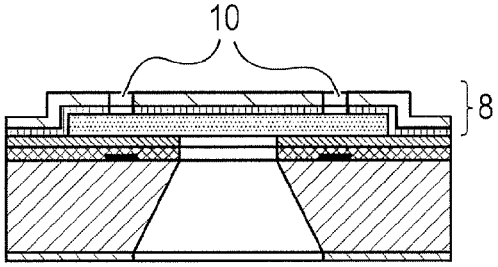
Figure 3B:
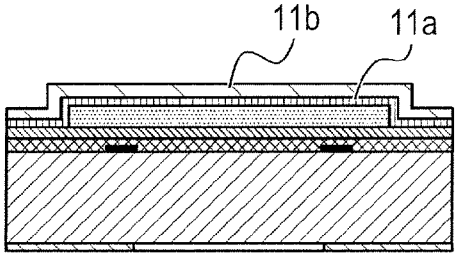
Figure 3E:
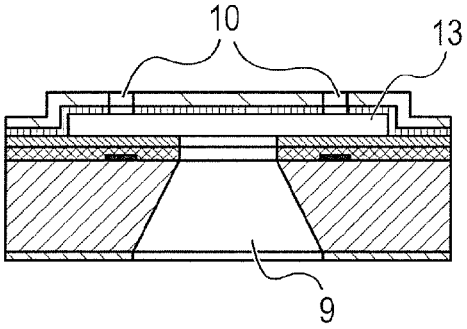
Figure 3C:
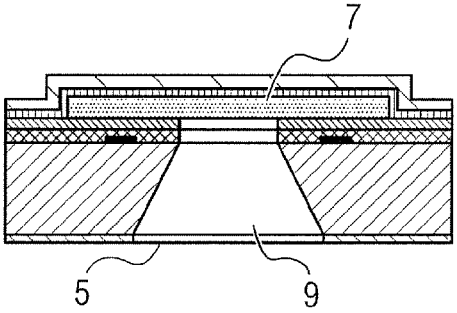

Next, as illustrated in FIG. 3C, the ink supply port 9 passing through the ejection element substrate and the metal layer 6 was formed with the thermal oxide film having the opening 5 formed therein being used as the mask. Specifically, a region of the ejection element substrate to be formed as the ink supply port 9 was etched by wet etching using BHF, and a region or the metal layer 6 to be formed as the ink supply port 9 was etched by dry etching. Thus, the ink supply port 9 was formed.

Next, as illustrated in FIG. 3D, by, after a resist was applied onto the second inorganic material layer 11*b* and exposure and development thereof were carried out, the first and second inorganic material layers 11*a* and 11*b* were etched by dry etching using a gas mixture of Ar and $CF_4$ as the etching gas to form the ink ejection orifices 10 (in the step 4).

Next, as illustrated in FIG. 3E, the ink flow path pattern 7 formed of the second metal was removed through the ink supply port 9 and the ink ejection orifices 10 using a liquid mixture of acetic acid, and phosphoric acid, and nitric acid at room temperature (25° C.) as the etchant to form the ink flow path 13 (in the step 5).

Next, a water-repellent film (not shown) containing Si was formed on the ink ejection orifice surface 8*a* by plasma polymerization, and an ink supply member (not shown) was bonded to the rear surface side of the ejection element substrate to complete the ink jet recording head.

Note that, the substrate illustrated in FIG. 3C has a structure in which the ink flow path pattern 7 formed of the second metal is covered with (surrounded by) the metal layer 6 formed of the first metal and the first inorganic material layer 11*a* formed of the third metal, and the second metal is held in contact with the first and third metals. Note that, in Example 3, Ir used as the first metal and Al used as the second metal are metals of different kinds, and the second metal and Ir used as the third metal are metals of different kinds. Further, the standard electrode potential E1 of this first metal is 1.156 V, the standard electrode potential E2 of this second metal is −1.676 V, and the standard electrode potential E3 of this third metal is 1.156 V, and thus, these metals satisfy the relationships of E1>E2 and E3>E2. Therefore, due to the galvanic corrosion, the etching rate of the ink flow path pattern 7 formed of the second metal in the step 5 was improved, and, irrespective of the unevenness on the surface of the ejection element substrate, the ink flow path pattern 7 was able to be removed with efficiency and with reliability.

Note that, in the structure of Example 3, etching due to the galvanic corrosion progresses also from the first inorganic material layer 11*a* side. Therefore, in the step 5, the etching rate of the ink flow path pattern 7 formed of the second metal was further improved, and, compared with the cases of Example 1 and Example 2, the ink flow path pattern 7 was able to be removed with further efficiency.

Example 4

The second metal used in Example 1 was changed from Al to Ti, and hydrogen peroxide water was used to etch and remove the second metal. The other points were similar to those in Example 1, and the ink jet recording head was completed. Ir used as the first metal and Ti used as the second metal in Example 4 are metals of different kinds. Further, the standard electrode potential E1 of this first metal is 1.156 V and the standard electrode potential E2 of this second metal is −1.63 V, and thus, these metals satisfy the relationship of E1>E2. Therefore, similarly to the case of Example 1, also in Example 4, due to the galvanic corrosion, the etching rate of the ink flow path pattern 7 formed of the second metal in the step 5 was improved, and, irrespective of the unevenness on the surface of the ejection element substrate, the ink flow path pattern 7 was able to be removed with efficiency and with reliability.

Example 5

The second metal used in Example 1 was changed from Al to W, and hydrogen peroxide water was used to etch and remove the second metal. The other points were similar to those in Example 1, and the ink jet recording head was completed. Ir used as the first metal and W used as the second metal in Example 5 are metals of different kinds. Further, the standard electrode potential E1 of this first metal is 1.156 V and the standard electrode potential E2 of this second metal is 0.1 V, and thus, these metals satisfy the relationship of E1>E2. Therefore, similarly to the case of Example 1, also in Example 5, due to the galvanic corrosion, the etching rate of the ink flow path pattern 7 formed of the second metal in the step 5 was improved, and, irrespective of the unevenness on the surface of the ejection element substrate, the ink flow path pattern 7 was able to be removed with efficiency and with reliability.

Example 6

The second metal used in Example 1 was changed from Al to TiW, and hydrogen peroxide water was used to etch and remove the second metal. The other points were similar to those in Example 1, and the ink jet recording head was completed. Ir used as the first metal and TiW used as the second metal in Example 6 are metals of different kinds. Further, the standard electrode potential E1 of this first metal is 1.156 V and the standard electrode potential E2 of this second metal is 0.16 V, and thus, these metals satisfy the relationship of E1>E2. Therefore, similarly to the case of Example 1, also in Example 6, due to the galvanic corrosion, the etching rate of the ink flow path pattern 7 formed of the second metal in the step 5 was improved, and, irrespective of the unevenness on the surface of the ejection element substrate, the ink flow path pattern 7 was able to be removed with efficiency and with reliability.

Example 7

Similarly to the case of Example 1 except that the material for forming the inorganic material layer 11 to be formed as the nozzle layer 8 was changed from SiCN to SiN, the ink jet recording head was completed. E1 and E2 were the same as those in Example 1. Also in Example 7, similarly to Example 1, due to the galvanic corrosion, the etching rate of the ink flow path pattern 7 formed of the second metal in the step 5 was improved, and, irrespective of the unevenness on the surface of the ejection element substrate, the ink flow path pattern 7 was able to be removed with efficiency and with reliability.

Example 8

Similarly to the case of Example 1 except that the material for forming the inorganic material layer 11 to be formed as the nozzle layer 8 was changed from SiCN to SiO, the ink jet recording head was completed. E1 and E2 were the same as those in Example 1. Also in Example 8, similarly to Example 1, due to the galvanic corrosion, the etching rate of the ink flow path pattern 7 formed of the second metal in the step 5 was improved, and, irrespective of the unevenness on the surface of the ejection element substrate, the ink flow path pattern 7 was able to be removed with efficiency and with reliability.

According to the present invention, the method of manufacturing a liquid ejection head can be provided, which can form the liquid flow path with high accuracy, which can stabilize the volume of a liquid droplet to be ejected from ejection orifices, and which can achieve high quality recording by removing with ease and with reliability the inorganic material (second metal) that forms the liquid flow path pattern.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-164687, filed Jul. 25, 2012, which is hereby incorporated by reference herein in its entirety.

What is claimed is:

1. A method of manufacturing a liquid ejection head, the liquid ejection head comprising:

a substrate having an ejection energy generating element for generating energy for ejecting a liquid formed therein; and a nozzle layer having an ejection orifice and a liquid flow path formed therein, the ejection orifice being provided for ejecting the liquid, the liquid flow path communicating to the ejection orifice and being provided for placing the liquid above the ejection energy generating element, the method comprising:

(1) forming a metal layer consisting of a first metal on the substrate having the ejection energy generating element formed therein;

(2) forming a liquid flow path pattern consisting of a second metal that is dissolvable in a solution that does not dissolve the first metal, the liquid flow path pattern being formed on at least a part of a surface of the metal layer;

(3) forming a material layer to be formed as the nozzle layer of multiple layers and covering the liquid flow path pattern with one of the multiple layers, the one of the multiple layers that covers the liquid flow path pattern consisting of a third metal that is not dissolvable in the solution;

(4) forming the ejection orifice in the material layer; and (5) dissolving the liquid flow path pattern in the solution to remove the liquid flow path pattern, to thereby form the liquid flow path, wherein the first metal and the second metal are metals of different kinds, wherein a standard electrode potential E1 of the first metal and a standard electrode potential E2 of the second metal have a relationship of "E1>E2", wherein the second metal and the third metal are metals of different kinds, and wherein a standard electrode potential E3 of the third metal is such that "E2<E3".

2. The method according to claim 1, wherein the material layer consists of an inorganic material.

3. The method according to claim 1, wherein E1 is positive and E2 is negative.

4. The method according to claim 1, wherein E2 is negative and E3 is positive.

5. The method according to claim 1, wherein the first metal and the third metal are same metals.

6. The method according to claim 1, wherein the metal layer is in contact with a wall of the one of the multiple layers that covers the liquid flow path pattern, the wall forming the liquid flow path.

7. The method according to claim 1, wherein:

the first metal is selected from the group consisting of Au, Pt, Ir, an alloy in which Au is its main component, an alloy in which Pt is its main component, and an alloy in which Ir is its main component; and the second metal is selected from the group consisting of Ti, W, and TiW.

8. The method according to claim 7, wherein in the step (5), the solution is selected from the group consisting of hydrogen peroxide water and a solution in which hydrogen peroxide water is its main component.

9. The method according to claim 7, wherein the third metal is selected from the group consisting of Au, Pt, Ir, an alloy in which Au is its main component, an alloy in which Pt is its main component, and an alloy in which Ir is its main component.

10. The method according to claim 7, wherein the material layer consists of an inorganic material.

11. The method according to claim 1, wherein:

the first metal is selected from the group consisting of Au, Pt, Ir, an alloy in which Au is its main component, an alloy in which Pt is its main component, and an alloy in which Ir is its main component; and the second metal is selected from the group consisting of Al and an alloy in which Al is its main component.

12. The method according to claim 11, wherein, in the step (5), the solution is selected from the group consisting of a liquid mixture of hydrochloric acid and phosphoric acid and a liquid mixture of acetic acid, phosphoric acid, and nitric acid.

13. The method according to claim 11, wherein the third metal is selected from the group consisting of Au, Pt, Ir, an alloy in which Au is its main component, an alloy in which Pt is its main component, and an alloy in which Ir is its main component.

14. The method according to claim 11, wherein the material layer consists of an inorganic material.

* * * * *